US012384733B2

(12) United States Patent
Mano

(10) Patent No.: US 12,384,733 B2
(45) Date of Patent: Aug. 12, 2025

(54) METHOD FOR EXTRACTING AMMONIUM PERCHLORATE FROM A SOLID COMPOSITE PROPELLANT

(71) Applicant: ArianeGroup SAS, Les Mureaux (FR)

(72) Inventor: Aurélie Mano, Andernos-les-Bains (FR)

(73) Assignee: ArianeGroup SAS, Les Mureaux (FR)

( * ) Notice: Subject to any disclaimer, the term of this patent is extended or adjusted under 35 U.S.C. 154(b) by 480 days.

(21) Appl. No.: 18/001,644

(22) PCT Filed: Jun. 15, 2021

(86) PCT No.: PCT/FR2021/051066
§ 371 (c)(1),
(2) Date: Dec. 13, 2022

(87) PCT Pub. No.: WO2021/255377
PCT Pub. Date: Dec. 23, 2021

(65) Prior Publication Data

US 2023/0219865 A1 Jul. 13, 2023

(30) Foreign Application Priority Data

Jun. 16, 2020 (FR) ..... 2006254

(51) Int. Cl.
*C06B 21/00* (2006.01)
*C06B 29/22* (2006.01)

(52) U.S. Cl.
CPC ..... *C06B 21/0091* (2013.01); *C06B 29/22* (2013.01)

(58) Field of Classification Search
None
See application file for complete search history.

(56) References Cited

U.S. PATENT DOCUMENTS 4,198,209 A * 4/1980 Frosch ..... C06B 21/0091 23/302 R
4,758,381 A * 7/1988 Suga ..... C07C 255/00 552/303
5,346,512 A 9/1994 Miks et al.
6,425,966 B1 * 7/2002 Highsmith ..... C06B 45/105 149/19.8

FOREIGN PATENT DOCUMENTS

FR 2689042 A1 10/1993
FR 2980373 A1 3/2013
WO 2015110095 A1 7/2015

OTHER PUBLICATIONS

International Search Report for Application No. PCT/FR2021/051066 dated Sep. 20, 2021.
Written Opinion for PCT/FR2021/051066 dated Sep. 20, 2021.

* cited by examiner

*Primary Examiner* — Aileen B Felton
(74) *Attorney, Agent, or Firm* — McDonald Hopkins LLC

(57) ABSTRACT

A method for recovering ammonium perchlorate from a solid composite propellant, the method being carried out at a temperature of less than 50° C. involving maceration of solid composite propellant fragments in the form of an aqueous suspension, the method being terminated when the ionic conductivity in the aqueous suspension reaches a stabilized value, of less than 60 mS/cm.

9 Claims, 2 Drawing Sheets

METHOD FOR EXTRACTING AMMONIUM PERCHLORATE FROM A SOLID COMPOSITE PROPELLANT

This is the National Stage of PCT international application PCT/FR2021/051066, filed on Jun. 15, 2021 entitled "METHOD FOR EXTRACTING AMMONIUM PERCHLORATE FROM A SOLID COMPOSITE PROPELLANT", which claims the priority of French Patent Application No. 2006254 filed Jun. 16, 2020, both of which are incorporated herein by reference in their entirety.

TECHNICAL FIELD

The present invention relates to the field of treatment and inerting of solid composite propellants.

Indeed, the present invention aims at providing a simple, easy to implement, environmentally friendly method allowing total extraction of ammonium perchlorate from composite propellants.

STATE OF PRIOR ART

Solid composite propellants are energetic compositions consisting of a macromolecular matrix of combustible polymer, called a binder, loaded with an oxidant and a reductant. In general, this oxidant and reductant are in solid powder form and in the form of a powdered metal respectively.

Solid composite propellants are widely used in astronautics in the take-off auxiliary boosters of space launchers or in the retrorockets of space probes. They are also used in "airbag" type devices for automobile safety.

The dismantling of thrusters or retrorockets with solid composite propellants in equipment return is a problem that has been studied for several years. Indeed, the return of thrusters and retrorockets leads to the problem of their destruction. The same applies to the production waste of solid composite propellants.

A first destruction method used for thrusters and retrorockets is to mount them on test stand to be fired, thus allowing their destruction. This process causes air pollution, especially when firing of the first and second stages of the thrusters, given the large amount of solid composite propellants to be burned.

A second method commonly used to dispose of solid composite propellant production waste is open burning. Combustion by open burning is limited by weather conditions and generates combustion products that are a source of atmospheric pollution.

Until now, the destruction of thrusters by burning was allowed. Environmental restrictions did not justify investment and study funding for a more environmentally friendly destruction project.

However, other more environmentally friendly methods have been developed, some of which involve underwater milling of solid composite propellant-based waste. Thus, patent application FR 2 931 814 provides a process for purifying aqueous solutions containing ammonium perchlorate and possibly nitrates, obtained as a result of this milling, prior to their disposal. In processes used up to now, underwater milling of solid composite propellant-based waste did not allow all the ammonium perchlorate to be extracted.

The inventors have therefore set themselves the goal of providing a process that is easy to implement and makes it possible to extract all of the ammonium perchlorate initially contained in the solid composite propellant-based waste and thus to externalise inert solid composite propellant waste in a conventional incineration route with flue gas treatment.

DISCLOSURE OF THE INVENTION

To this end, the present invention provides a method for recovering ammonium perchlorate contained in a solid composite propellant, said method comprising the steps of:

i) contacting, with a first aqueous solution, the solid composite propellant in the form of pieces;

ii) subjecting said pieces of solid composite propellant present in said first aqueous solution to fragmentation so as to obtain fragments of solid composite propellant whose largest dimension does not exceed 10 mm;

iii) adding, to the mixture obtained in step ii), a second aqueous solution in which the amount of water is such that the mass ratio W/P is between 2.5 and 6.8 with W representing the sum of the mass of water in the first aqueous solution and the mass of water in the second aqueous solution and P representing the mass of solid composite propellant present in the form of pieces and stirring the whole whereby an aqueous suspension is obtained;

iv) keeping said stirring for a time sufficient for the ammonium perchlorate to solubilise in the continuous phase of said suspension, said solubilisation being monitored by measuring the ionic conductivity of said aqueous suspension;

v) separating the dispersed phase and the continuous phase of said aqueous suspension once the ionic conductivity reaches a stabilized value, of less than 60 mS/cm;

steps (i) to (iv) of said method being carried out at the same or different temperature, of less than or equal to 50° C.

The method according to the invention has at least one of the following optional characteristics, taken alone or in combination.

The largest dimension of the pieces of solid composite propellant implemented in step i) does not exceed 50 mm.

The dimensions of the pieces of solid composite propellant implemented in step i) are less than or equal to the dimensions of a rectangular parallelepiped of 25 mm×25 mm×50 mm.

The W/P mass ratio is equal to 4.

In said step iv), if the ionic conductivity of the aqueous suspension has a stabilized value greater than or equal to 60 mS/cm, part of the continuous phase of the suspension is replaced with a third aqueous solution.

Steps (i) to (iv) of the method are carried out at the same or a different temperature, of between 30° C. and 40° C.

The first aqueous solution, the second aqueous solution and/or the third aqueous solution comprises an anti-sticking agent.

The first aqueous solution consists of water and an anti-sticking agent, the second aqueous solution consists of water and/or the third aqueous solution consists of water.

The anti-sticking agent is selected from the group consisting of talc, glycerol monostearate, kaolin, calcium carbonate, magnesium trisilicate, stearic acid, calcium stearate, magnesium stearate, zinc stearate, glycerol monostearate, glycerol palmitostearate, polyethylene glycol, benenic acid glycerol ester, colloidal silicon dioxide, finely divided silicon dioxide, aluminium hydroxide, hydrogenated vegetable oil, anionic surfactants, non-ionic surfactants and amphoteric surfactants.

DETAILED DISCLOSURE OF PARTICULAR EMBODIMENTS

Figure 1:
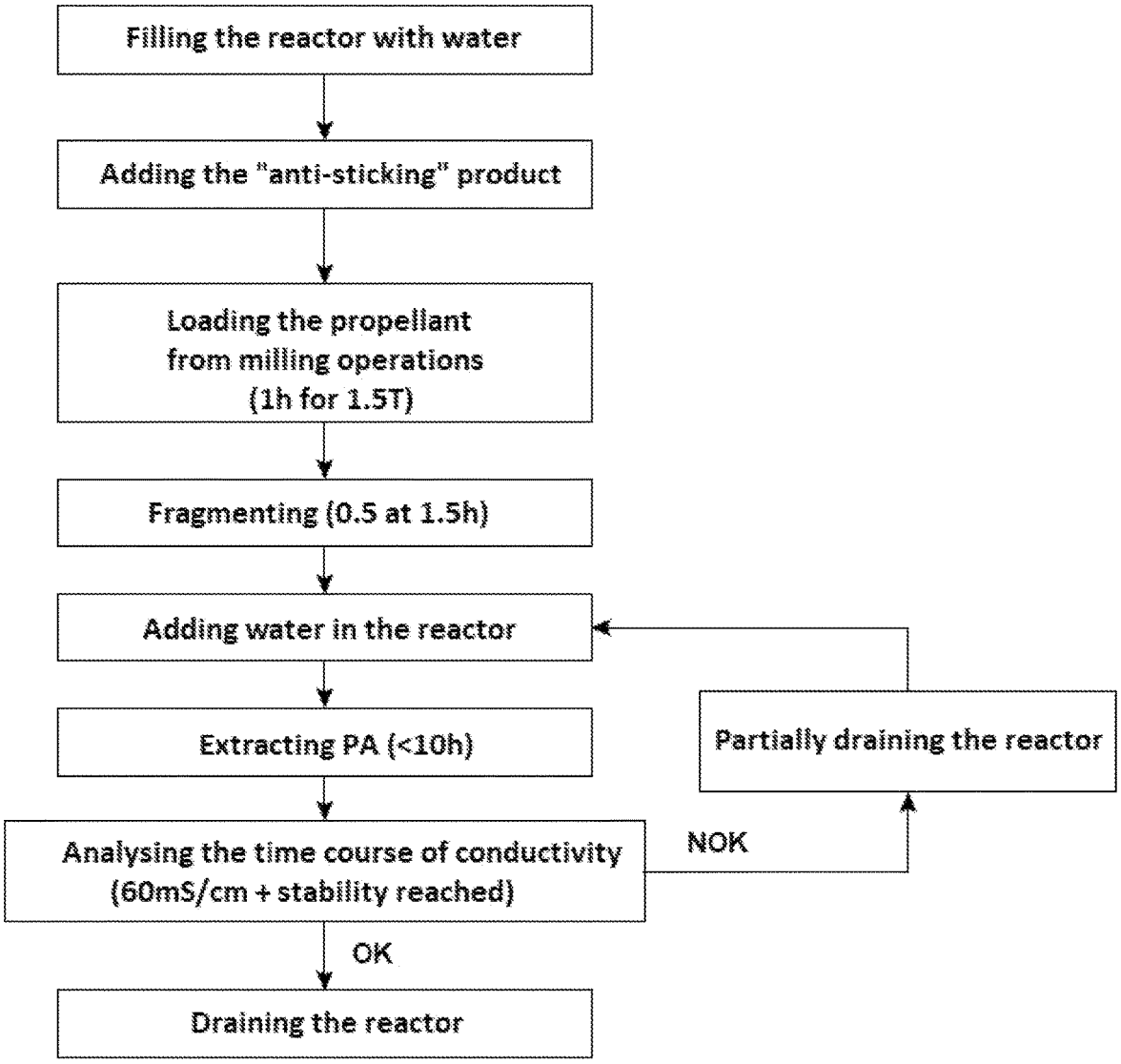
FIG. 1 is a schematic diagram of the method for recovering ammonium perchlorate from solid composite propellant according to the present invention.

The present invention provides a method for treating a solid composite propellant which makes it possible to extract and recover at least 95%, at least 97%, at least 98%, at least 99%, at least 99.5% by mass and ideally all of the ammonium perchlorate ($NH_4ClO_4$) which it contains.

Indeed, the inventors have shown that from a reasoned combination of the parameters implemented during the step of extracting ammonium perchlorate from a solid composite propellant, namely the size of the pieces and fragments of solid composite propellant input to the method, the mass ratio between water and propellant and the extraction temperature, it is possible to ensure total extraction of the ammonium perchlorate initially contained in the solid composite propellant.

First of all, the method for recovering ammonium perchlorate from solid composite propellant according to the invention is included in an environmentally friendly route of treating solid composite propellant-based waste. Indeed, the invention allows the solid composite propellant to be inerted by an ammonium perchlorate extraction method and thus the inert solid composite propellant waste to be externalised into a conventional incineration route with flue gas treatment.

The method for recovering ammonium perchlorate from solid composite propellant according to the invention is carried out entirely under water, allowing the propellant to be cut up while minimising the risks. Furthermore, the operating conditions implemented within the scope of the method according to the invention, namely little heating, simple mechanics and a high proportion of water, have the advantage of being a simple method with operating conditions with limited risks, this method being considered as non-pyrotechnical after loading the reactor with the extraction agent. In particular, the temperature control during the method according to the invention makes it possible to minimise reaction of the reductant such as the powdered aluminium contained in the solid composite propellant with water contained in the different aqueous solutions implemented.

Finally, the method for recovering ammonium perchlorate from solid composite propellant according to the invention makes it possible to obtain not only an aqueous solution containing all of the ammonium perchlorate but also a reductant-containing polymeric residue having an interesting calorific potential for the incineration route in which extraction residues are treated.

Thus, the present invention relates to a method for recovering ammonium perchlorate contained in a solid composite propellant, said method comprising the steps of:

i) contacting, with a first aqueous solution, the solid composite propellant in the form of pieces;

ii) subjecting said pieces of solid composite propellant present in said first aqueous solution to fragmentation so as to obtain fragments of solid composite propellant the largest dimension of which does not exceed 10 mm;

iii) adding, to the mixture obtained in step ii), a second aqueous solution in which the amount of water is such that the mass ratio W/P is between 2.5 and 6.8 with W representing the sum of the mass of water in the first aqueous solution and the mass of water in the second aqueous solution and P representing the mass of solid composite propellant present in the form of pieces and stirring the whole whereby an aqueous suspension is obtained;

iv) keeping said stirring for a time sufficient for the ammonium perchlorate to solubilise in the continuous phase of said suspension, said solubilisation being monitored by measuring the ionic conductivity of said aqueous suspension;

v) separating the dispersed phase and the continuous phase of said aqueous suspension once the ionic conductivity reaches a stabilized value, of less than 60 mS/cm;

steps (i) to (iv) of said method being carried out at a temperature, identical or different, of less than or equal to 50° C.

By "solid composite propellant», it is meant, within the scope of the present invention, an energetic composition comprising a polymeric binder, a reductant and an oxidant, said oxidant comprising or consisting of ammonium perchlorate.

The present invention applies to any solid composite propellant whose oxidant comprises or consists of ammonium perchlorate, regardless of the natures of the polymeric binder and of the reductant.

Typically, the polymeric binder present in the solid composite propellant treated within the scope of the present invention is a polyurethane or a polybutadiene such as, for example, a hydroxytelechelic polybutadiene (HTPB), a polybutadiene-acrylic acid-acrylonitrile terpolymer (PBAN) or a carboxytelechelic polybutadiene (CTPB).

Typically, the reductant present in the solid composite propellant treated within the scope of the present invention is powdered aluminium or powdered magnesium.

The solid composite propellant treated within the scope of the present invention is essentially derived from solid composite propellant production departments or from drain departments of equipment return thrusters. The solid composite propellant therefore comes in various sizes and shapes. Generally, the maximum size of solid composite propellant is 80 cm.

The inventors have shown that one of the parameters promoting total extraction of ammonium perchlorate is the size of the solid composite propellant pieces input to the method. Thus, the largest dimension of these pieces does not exceed 50 mm.

For this purpose, it may be necessary to subject the solid composite propellant to one or more milling steps before implementing the method according to the invention. Typically, the solid composite propellant is subjected to two preliminary milling steps carried out by means of knife mills. These two milling steps make it possible to obtain composite propellant pieces the largest dimension of which is less than or equal to 50 mm and, in particular, the dimensions of which are less than or equal to the dimensions of a rectangular parallelepipe of 25 mm×25 mm×50 mm.

The solution implemented in step i) of the method according to the invention comprises, as solvent, water, thus explaining the designation of aqueous solution. By "water», it is meant, within the scope of the invention, tap water, deionised water, distilled water or even ultra-pure water (18.2 MΩ). The solution implemented in step i) of the method according to the invention may be a neutral, acidic or basic aqueous solution. Typically, the solution implemented in step i) is an aqueous solution with a pH between 4 and 9.

Typically, the aqueous solution implemented in step i) only comprises water i.e. it consists of water. Alternatively, it may comprise at least one other element in addition to the solvent which is water. This other element is especially an anti-sticking agent.

By "anti-sticking agent», it is meant a compound capable of limiting sticky nature of the pieces and subsequently of the fragments of solid composite propellant and thus of preventing the pieces and subsequently the fragments of solid composite propellant from aggregating together and re-agglomerating. It should be noted that the temperature of steps (i) to (iv) less than 50° C. and especially between 30° C. and 40° C. also makes it possible to control re-agglomeration of the pieces or fragments of solid composite propellant. Any anti-sticking agent known to the person skilled in the art is usable within the scope of the invention. Advantageously, the anti-sticking agent implemented within the scope of the invention is selected from the group consisting of talc, glycerol monostearate, kaolin, calcium carbonate, magnesium trisilicate, stearic acid, calcium stearate, magnesium stearate, zinc stearate, glycerol monostearate, glycerol palmitostearate, polyethylene glycol, benenic acid glycerol ester, colloidal silicon dioxide, finely divided silicon dioxide, aluminium hydroxide, hydrogenated vegetable oil, anionic surfactants, non-ionic surfactants and amphoteric surfactants.

As a reminder, a surfactant is a molecule including a lipophilic (apolar) part and a hydrophilic (polar) part.

Among the latter, the anionic surfactants have a negatively charged hydrophilic part such as alkyl or aryl sulfonates, sulphates, phosphates or sulfosuccinates associated with a counter ion such as an ammonium ion ($NH_4^+$), a quaternary ammonium such as tetrabutylammonium, and alkaline cations such as Na+, Li+ and K+. As anionic surfactants, it is, for example, possible to use tetraethylammonium paratoluenesulfonate, sodium dodecylsulphate, sodium palmitate, sodium stearate, sodium myristate, sodium di(2-ethylhexyl) sulfosuccinate, methylbenzene sulfonate and ethylbenzene sulfonate.

The surface-active properties of non-ionic (or neutral) surfactants, especially hydrophilicity, are provided by uncharged functional groups such as an alcohol, an ether, an ester or an amide, containing heteroatoms such as nitrogen or oxygen; due to the low hydrophilic contribution of these functions, non-ionic surfactant compounds are usually polyfunctional. As non-ionic surfactants, it is possible to employ polyethers such as polyethoxylated surfactants such as, for example, polyethylene glycol lauryl ether (POE23 or Brij® 35), polyols (sugar-derived surfactants) in particular glucose alkylates such as, for example, glucose hexanate.

Amphoteric surfactants are compounds behaving both an acid and a base depending on the medium in which they are placed. As amphoteric surfactants, it is possible to use disodium lauroamphodiacetate, betaines such as alkylamidopropylbetaine or laurylhydroxysulfobetaine.

When it is present in the first aqueous solution implemented in step i), the anti-sticking agent is used in an amount of less than or equal to 5% by mass relative to the mass of propellant treated and especially in an amount of between 1% and 3% by mass relative to the mass of propellant treated.

Contacting during step i) is carried out in a reactor the dimensions of which are adapted to the amount of solid composite propellant to be treated.

Different implementations can be contemplated for performing contacting the pieces of solid composite propellant with the first aqueous solution, optionally containing, in addition to water, an additional element such as an anti-sticking agent. Thus, it is possible to place, in the reactor, the first aqueous solution and then the pieces of solid composite propellant or the pieces of solid composite propellant and then the first aqueous solution. In these different cases and if the first aqueous solution contains, in addition to water, an additional element such as an anti-sticking agent, the latter can be placed in the reactor before or after the first aqueous solution or before or after the pieces of solid composite propellant or can be previously mixed with the first aqueous solution before the latter is introduced into the reactor.

FIG. 1 illustrates the particular embodiment in which water is introduced into the reactor and then the anti-sticking agent is added to this water whereby a first aqueous solution consisting of water and anti-sticking agent is obtained and then the solid composite propellant pieces are introduced into the reactor filled with this first aqueous solution.

The duration of step i) is variable and is essentially dependent on the amount of solid composite propellant pieces to be introduced into the reactor. Typically, step i) can last between 30 min and 2 h. By way of example, step i) may last about 1 h (i.e. 1 h±15 min), especially for 1.5 $10^3$ kg of solid composite propellant pieces, as illustrated in FIG. 1.

Step i) is carried out at a temperature less than or equal to 50° C. and especially at a temperature between 30° C. and 40° C. For this purpose, step i) is carried out in a thermostatically controlled reactor.

Step ii) of the method according to the invention is a step of fragmenting the pieces of solid composite propellant so as to obtain fragments of solid composite propellant having a smaller size i.e. fragments the largest dimension of which is less than or equal to 10 mm and, in particular, the dimensions of which are less than or equal to the dimensions of a cube of 10 mm×10 mm×10 mm.

This fragmentation is achieved by virtue of means usually used in reactors to fragment, disperse and/or mill elements, such as a dispersion/fragmentation turbine or a rotor-stator system. These means advantageously have a peripheral speed greater than or equal to 10 m/s.

The duration of step ii) is variable and is essentially dependent on the amount of solid composite propellant pieces to be fragmented in the reactor. Typically, step ii) can last between 15 min and 2.5 h. By way of example, step ii) may last between 30 min and 90 min, especially for 1.5 $10^3$ kg of solid composite propellant pieces to be fragmented, as illustrated in FIG. 1.

Step ii) is carried out at a temperature less than or equal to 50° C. and especially at a temperature between 30° C. and 40° C. For this purpose, step ii) is carried out in a thermostatically controlled reactor. Step ii) is carried out in the same thermostatically controlled reactor as that implemented for step i).

In step iii), a second aqueous solution is added, in the thermostatically controlled reactor implemented in steps i) and ii), to the mixture obtained at the end of step ii). This mixture consists of the solid composite propellant fragments dispersed in the first aqueous solution, it being possible for some of the ammonium perchlorate initially present in the solid composite propellant pieces to be already in solubilised form in this first aqueous solution.

The second aqueous solution implemented in step iii) of the method according to the invention comprises water as a solvent, thus explaining the designation of aqueous solution. Typically, the second aqueous solution implemented in step iii) only comprises water, i.e. it consists of water. Alternatively, it may comprise at least one other element in addition to the solvent which is water. This other element is especially an anti-sticking agent as previously defined. When it is present in the second aqueous solution implemented in step iii), the anti-sticking agent is used in an amount of less than or equal to 5% by mass relative to the mass of propellant treated and especially in an amount of between 1% and 3% by mass relative to the mass of propellant treated. The composition of the second aqueous solution may be identical to or different from the composition of the first aqueous solution.

FIG. 1 illustrates the embodiment in which the second aqueous solution only comprises water i.e. consists of water.

As previously explained, the work of the inventors has shown that one of the parameters influencing total extraction of the ammonium perchlorate initially contained in the pieces of solid composite propellant is the mass ratio between the mass of water contained in the first aqueous solution and in the second aqueous solution, designated "W", and the mass of solid composite propellant to be treated, designated "P". This mass corresponds, in fact, to the mass of the pieces of solid composite propellant implemented in step i) of the method according to the invention. It is obvious that the mass of water and the mass of propellant should be expressed in the same mass unit. This W/P mass ratio is between 2.5 and 6.8, especially between 3 and 6, in particular between 3.5 and 5, and more particularly the W/P mass ratio is equal to 4. In fact, the amount of second aqueous solution implemented in step ii) will depend on the amount of water it contains, the amount of water contained in the first aqueous solution and the targeted W/P mass ratio.

During step iii) and following the addition of the second aqueous solution, the whole is stirred and an aqueous suspension is obtained. This aqueous suspension initially comprises a dispersed phase corresponding to the solid composite propellant fragments and a continuous phase comprising the mixture of the first aqueous solution and the second aqueous solution and optionally part of the already solubilised ammonium perchlorate.

Step iii) implemented in the thermostatically controlled reactor used in steps i) and ii) is carried out at a temperature of less than or equal to 50° C. and especially at a temperature of between 30° C. and 40° C.

Step iv) of the method according to the invention is the ammonium perchlorate extraction step proper. Indeed, by keeping stirring, the fragments of solid composite propellant are kept in suspension and the solubilisation of the perchlorate in the continuous phase of the suspension is promoted. It is obvious that the chemical composition of the aqueous suspension changes during step iv), the solid composite propellant fragments losing the powdered ammonium perchlorate they initially contained over time, while at the same time the continuous phase of the aqueous suspension is enriched with dissolved ammonium perchlorate.

Step iv) is carried out in the same thermostatically controlled reactor as that implemented in steps i) to iii) of the method according to the present invention. Consequently, step iv) is carried out at a temperature less than or equal to 50° C. and especially at a temperature of between 30° C. and 40° C.

Furthermore, the thermostatically controlled reactor is equipped with means adapted to stir and keep the solid composite propellant fragments in suspension. Any means known to the person skilled in the art for this purpose is usable within the scope of the invention. Typically, the means adapted to stir and keep the fragments of solid composite propellant in suspension are especially a three-bladed propeller optionally associated with a counter-rotating anchor. The dimensions of the three-bladed propeller are defined by the targeted fluidisation rate as a function of the characteristics of the solid composite propellant fragments dispersed in the suspension. The counter-rotating anchor in turn serves to limit dead zones and reduce vortex to avoid cavitation of the dispersion means.

The thermostatically controlled reactor is also equipped with means adapted to measure the ionic conductivity of the suspension contained in said reactor. Any means known to the skilled artisan for measuring ionic conductivity can be used within the scope of the present invention. Typically, the thermostatically controlled reactor is equipped with a conductivity meter arranged to measure the ionic conductivity of the suspension it contains.

During step iv), the measurement ionic conductivity may be performed in a continuous or punctual way, wherein the time interval between two successive measurements may be regular or irregular.

The duration of step iv) is variable and essentially dependent on the amount of composite propellant fragments. Typically, step iv) can last between 6 h and 15 h. By way of example, step iv) may last less than 10 h and especially between 8 h and 9.5 h, especially for 1.5 $10^3$ kg of solid composite propellant pieces initially implemented, as illustrated in FIG. 1.

Step v) of the method according to the invention is the step at which the end of the extraction is allowed, from the moment when the ionic conductivity in the suspension reaches a stabilized value, lower than 60 mS/cm.

By stabilized value, it is meant a value of the ionic conductivity measured in the suspension that does not vary upwards or downwards by more than 1 mS/cm for a period of more than 60 seconds. This stabilization phase can be longer or shorter depending on the product, ranging from 1 h to 6 h. The stability of the signal is studied by the automaton after a time of 1 h that cannot be shortened to ensure total extraction on weakly loaded products.

Thus, during step v) of the method according to the present invention, the dispersed phase and the continuous phase are separated from the aqueous suspension obtained at the end of the extraction.

In the latter, the dispersed phase essentially comprises the polymer acting as a binder in the solid composite propellant, this polymer containing the reductant of the solid composite propellant such as aluminium or magnesium. This residue is therefore no longer a pyrotechnic product. It can be treated by conventional routes of incinerating or recovering the reductant such as aluminium.

The continuous phase of the aqueous suspension obtained at the end of extraction is an aqueous solution containing ammonium perchlorate. This solution, usually called "brine", can be treated biologically, as provided in the patent application FR 2 931 814, before being discharged.

This separation in step v) of the method is carried out by emptying the reactor in which steps i) to iv) have been implemented. The two phases are extracted and a liquid-solid separation allows the continuous phase to be recovered for biological treatment; and the solid phase to be recovered for an optional dewatering phase prior to reclaiming by incineration.

Once the ammonium perchlorate has been extracted, it is not necessary for step v) of the method according to the present invention to be carried out at a temperature of between 30° C. and 40° C. This step v) may be carried out at room temperature. By "room temperature», it is meant a temperature of the order of 23° C. (i.e. 23° C.±5° C.).

Following the separation of the dispersed phase from the continuous phase in step v), it is possible that the dispersed phase thus recovered is dewatered so as to extract as much continuous phase as possible. Any dewatering technique known to the person skilled in the art is usable within the scope of the invention.

During step iv) of the method according to the present invention, it is possible that the ionic conductivity of the aqueous suspension has a stabilized value greater than or equal to 60 mS/cm. Such a stabilized value does not mean that the extraction of ammonium perchlorate is complete, but rather that it is necessary to renew the continuous phase of the suspension to ensure inert nature of the residues at the end of the method and to complete extraction of the ammonium perchlorate still present in the dispersed phase.

Therefore, under such conditions i.e. ionic conductivity of the aqueous suspension having a stabilized value, greater than or equal to 60 mS/cm, part of the continuous phase of the suspension is replaced with a third aqueous solution. In other words, part of the continuous phase of the suspension is drained from the thermostatically controlled reactor in which step iv) is performed and a third aqueous solution is introduced into this reactor. Typically, the volume of third aqueous solution introduced is the same as the volume of continuous phase drained. In one particular embodiment, half of the continuous phase in the reactor is drained.

The third aqueous solution implemented in the method according to the invention comprises, as a solvent, water, thus explaining the designation of aqueous solution. Typically, the third aqueous solution implemented only comprises water, i.e. it consists of water. Alternatively, it may comprise at least one other element in addition to the solvent which is water. This other element is especially an anti-sticking agent as previously defined. When it is present in the third aqueous solution, the anti-sticking agent is used in an amount of less than or equal to 5% by mass relative to the mass of propellant treated and especially in an amount of between 1% and 3% by mass relative to the mass of propellant treated. The composition of the third aqueous solution may be the same as or different from the composition of the first aqueous solution and may be the same as or different from the composition of the second aqueous solution.

FIG. 1 illustrates the embodiment in which the third aqueous solution only comprises water i.e. consists of water.

Once part of the continuous phase of the suspension is replaced with a third aqueous solution, step iv) is continued i.e. stirring the resulting suspension is continued until a stabilized value of the ionic conductivity is again obtained. Depending on the value of the stabilized ionic conductivity obtained, either step v) will be implemented (value less than 60 mS/cm), or the reactor will be emptied again and a new aqueous solution will be supplied (value greater than or equal to 60 mS/cm).

Figure 2:
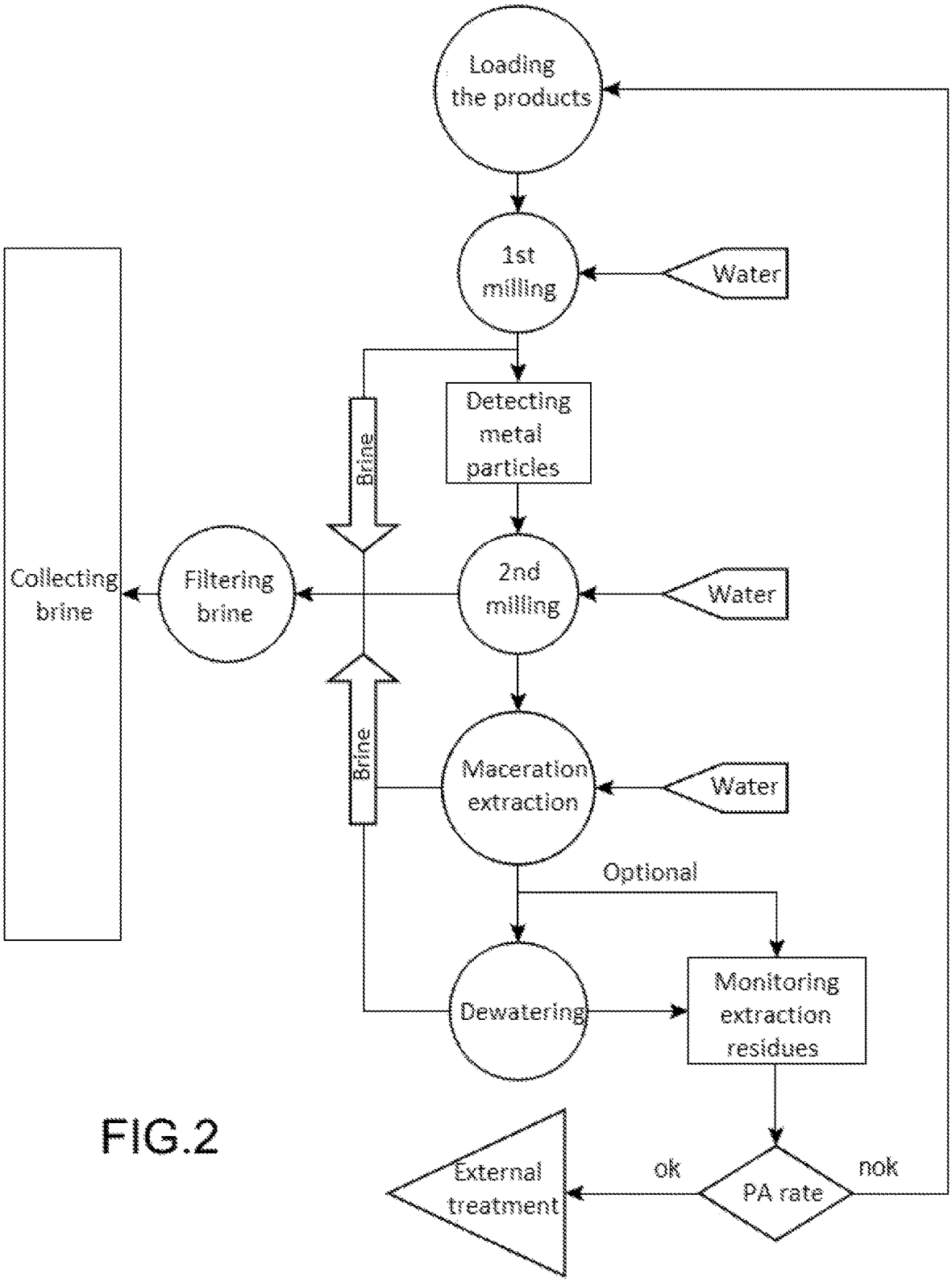
FIG. 2 is a schematic diagram of the flows of the complete solid composite propellant processing line in which the "maceration extraction" block corresponds to the ammonium perchlorate recovery method according to the present invention.

FIG. 2 shows all the stages in the method for treating a solid composite propellant, among which the method for recovering ammonium perchlorate according to the invention corresponds to the "maceration extraction" block. Among the other blocks, there are steps prior or subsequent to the method according to the invention, previously described, such as the milling and dewatering steps.

What is claimed is:

1. A method for recovering ammonium perchlorate contained in a solid composite propellant, said method comprising the steps of:

i) contacting, with a first aqueous solution, the solid composite propellant in the form of pieces;

ii) subjecting said pieces of solid composite propellant present in said first aqueous solution to fragmentation so as to obtain fragments of solid composite propellant the largest dimension of which does not exceed 10 mm;

iii) adding, to the mixture obtained in step ii), a second aqueous solution in which the amount of water is such that the W/P mass ratio is between 2.5 and 6.8 with W representing the sum of the mass of water in the first aqueous solution and the mass of water in the second aqueous solution and P representing the mass of solid composite propellant present in the form of pieces and stirring the whole whereby an aqueous suspension is obtained;

iv) keeping said stirring for a time sufficient for the ammonium perchlorate to solubilise in the continuous phase of said suspension, said solubilisation being monitored by measuring the ionic conductivity of said aqueous suspension;

v) separating the dispersed phase and the continuous phase of said aqueous suspension once the ionic conductivity reaches a stabilized value of less than 60 mS/cm;

steps (i) to (iv) of said method being carried out at a temperature, identical or different, of less than or equal to 50° C.

2. The method according to claim 1, wherein the largest dimension of said pieces of solid composite propellant used in said step i) does not exceed 50 mm.

3. The method according to claim 1, wherein the dimensions of said pieces of solid composite propellant implemented in said step i) are less than or equal to the dimensions of a rectangular parallelepipe of 25 mm×25 mm×50 mm.

4. The method according to claim 1, characterised in that said W/P mass ratio is equal to 4.

5. The method according to claim 1, wherein, during said step iv), if the ionic conductivity of said aqueous suspension has a stabilized value greater than or equal to 60 mS/cm, part of the continuous phase of said suspension is replaced with a third aqueous solution.

6. The method according to claim 1, wherein said steps (i) to (iv) are carried out at a temperature, identical or different, between 30° C. and 40° C.

7. The method according to claim 1, wherein said first aqueous solution, said second aqueous solution and/or said third aqueous solution comprises an anti-sticking agent.

8. The method according to claim 1, wherein first aqueous solution consists of water and an anti-sticking agent, said second aqueous solution consists of water and/or said third aqueous solution consists of water.

9. The method according to claim 7, wherein said anti-sticking agent is selected from the group consisting of talc, glycerol monostearate, kaolin, calcium carbonate, magnesium trisilicate, stearic acid, calcium stearate, magnesium stearate, zinc stearate, glycerol monostearate, glycerol palmitostearate, polyethylene glycol, benenic acid glycerol ester, colloidal silicon dioxide, finely divided silicon dioxide, aluminium hydroxide, hydrogenated vegetable oil, anionic surfactants, non-ionic surfactants and amphoteric surfactants.

* * * * *